US012098622B2

(12) United States Patent
Wu et al.

(10) Patent No.: US 12,098,622 B2
(45) Date of Patent: Sep. 24, 2024

(54) SELF-ENTRY EXPLOITATION DEVICE AND METHOD FOR MARINE NATURAL GAS HYDRATES

(71) Applicant: FU ZHOU UNIVERSITY, Minhou Fujian (CN)

(72) Inventors: Xuezhen Wu, Minhou Fujian (CN); Yujing Jiang, Minhou Fujian (CN); Dayong Li, Minhou Fujian (CN)

(73) Assignee: FU ZHOU UNIVERSITY

( * ) Notice: Subject to any disclaimer, the term of this patent is extended or adjusted under 35 U.S.C. 154(b) by 0 days.

(21) Appl. No.: 17/272,934

(22) PCT Filed: Jan. 4, 2021

(86) PCT No.: PCT/CN2021/070114

§ 371 (c)(1),
(2) Date: Jul. 12, 2023

(87) PCT Pub. No.: WO2022/126802

PCT Pub. Date: Jun. 23, 2022

(65) Prior Publication Data

US 2023/0392480 A1 Dec. 7, 2023

(30) Foreign Application Priority Data

Dec. 18, 2020 (CN) ..... 202011499869.7

(51) Int. Cl.
*E21B 7/26* (2006.01)
*E21B 33/127* (2006.01)
(Continued)

(52) U.S. Cl.
CPC ..... *E21B 41/0099* (2020.05); *E21B 7/26* (2013.01); *E21B 33/127* (2013.01); *E21B 43/08* (2013.01); *E21B 43/128* (2013.01); *E21B 43/267* (2013.01)

(58) Field of Classification Search
CPC ..... E21B 7/26; E21B 33/127; E21B 41/0099; E21B 43/08; E21B 43/128; E21B 43/267
See application file for complete search history.

(56) References Cited

U.S. PATENT DOCUMENTS 8,191,436 B2 * 6/2012 Chun ..... E21B 49/025 73/864.44

FOREIGN PATENT DOCUMENTS

CN 200810038546.0 A 6/2008
CN 106499368 A * 3/2017 ..... E21B 43/01
(Continued)

OTHER PUBLICATIONS

"Ocean Engineering Design Manual, Offshore Construction Volume", small book-c-Gwick, p. 214, Shanghai Jiaotong University Press, 1st edition.

*Primary Examiner* — Matthew R Buck
(74) *Attorney, Agent, or Firm* — Jose Cherson Weissbrot

(57) ABSTRACT

A self-entry exploitation device and method for marine natural gas hydrates is provided. The exploitation device includes a self-entry structural body (1), a sand control device (2) and a gas-liquid lifting system. The self-entry structural body (1) is a gravity anchor. The sand control device (2) and the gas-liquid lifting system are mounted on the self-entry structural body (1). At least one cavity (21) is formed between the self-entry structural body (1) and the sand control device (2), and the cavity (21) is communicated with at least one channel. The sand control device (2) allows liquid and gas to pass through to enter the cavity (21) and is able to filter out silt. The gas-liquid lifting system includes at least one lifting power device (31) and has an end connected to the cavity (21) and an end extending out through a pipeline. By adoption of the exploitation device, drilling is not needed, the self-entry structural body (1) can enter a natural gas hydrate reservoir or a free gas layer below
(Continued)

the natural gas hydrate reservoir, so that depressurizing exploitation can be realized, an exploitation system can be withdrawn, and the exploitation cost of natural gas hydrates can be greatly reduced.

9 Claims, 10 Drawing Sheets

(51) Int. Cl.

| | |
|---|---|
| ***E21B 41/00*** | (2006.01) |
| ***E21B 43/08*** | (2006.01) |
| ***E21B 43/12*** | (2006.01) |
| ***E21B 43/267*** | (2006.01) |

(56) References Cited

FOREIGN PATENT DOCUMENTS

| | | | | | |
|---|---|---|---|---|---|
| CN | 201711313026.1 | A | | 12/2017 | |
| CN | 108798608 | A | * | 11/2018 | ..... E21B 17/20 |
| CN | 201910732654.6 | A | | 8/2019 | |
| KR | 20130141302 | A | * | 12/2013 | |

* cited by examiner

SELF-ENTRY EXPLOITATION DEVICE AND METHOD FOR MARINE NATURAL GAS HYDRATES

TECHNICAL FIELD

The present invention relates to a self-entry exploitation device and method for marine natural gas hydrates.

BACKGROUND

Natural gas hydrates, as green energy, have a high exploitation potential and high resource value. It is commonly believed at present that the depressurization method and other improved solutions based on the depressurization method may be the optimum approach for realizing industrial pilot productions of the marine natural gas hydrated, and other methods are used to assist the depressurization method in increasing the output or stabilizing gas production.

Regarding specific implementations of natural gas hydrate exploitation, existing exploitation methods include drilling methods and superficial exploitation methods. The drilling methods realize natural gas hydrate exploration as follows: an offshore drilling ship drills a well on the seabed of a deep sea, and then the pressure in a wellbore is reduced to realize exploitation by depressurization or solid fluidization. Such methods can exploit natural gas hydrates 10 m-500 m deep below the seabed. The superficial exploitation methods are implemented in the following manner: an exploitation machine or device is directly lowered to the surface of the seabed to directly collect massive natural gas hydrates or natural gas converted from the massive natural gas hydrates by local depressurization of a protection hood. Such methods are mainly used to exploit natural gas hydrates several meters below the surface of the seabed.

Exploitation methods based on the drilling technology include: (1) exploitation methods based on drilling depressurization: "Ye Jiang Liang et al., Main progress of the second gas hydrate trial production in the South China Sea, Geology in China, 2020", "CN107676058B—Mortar replacement exploitation method and device for marine natural gas hydrates", "CN109763794B—Multi-branch horizontal well depressurization and heating united mining method for marine hydrates", "CN101672177B—Exploitation method for submarine natural gas hydrates", etc.; (2) exploitation methods based on drilling solid-fluidization: "Zhou Shou Wei et al., Optimal design of the engineering parameters for the first global trial production of marine natural gas hydrates through solid fluidization, Natural Gas Industry, 2017", "CN106939780B—Device and method for solid-fluidization mining of submarine superficial non-diagenetic natural gas hydrates", "CN110700801B—Automatic jet crushing tool for solid-fluidization mining of natural gas hydrates", etc.

Technical Problems

Up to now, around the world, Japan has successfully carried out two trial productions of marine natural gas hydrates through the drilling depressurization method, and China has successfully carried out two times of trial productions of marine natural gas hydrates through the drilling depressurization method and one time of trial production of marine natural gas hydrates through the drilling solid-fluidization method, and all these trial productions were based on the drilling exploitation technique. However, the decomposition of natural gas hydrates around the wellbore may lead to a drastic reduction of reservoir strength, a large amount of silt will surge out of the stratum under the effect of huge crustal stress, which in turn results in instability of the wellbore, and thus, it is impossible to realize long-term stable exploitation. This problem happened to multiple times of trial productions of marine natural gas hydrates carried out at home and abroad. In addition, a deep-sea drilling ship has to be used for the exploitation methods based on the drilling technology, and the rent of the deep-sea drilling ship is about 7,000,000, so about 200,000,000 RMB will be spent in one drilling cycle which is about 30 days, while the value of produced natural gas is far from reaching the drilling cost, so commercial exploitation has not be realized yet, at present.

Techniques based on the superficial exploitation methods include: (1) capping depressurization methods; "Li Wei et al., Study on exploitation mechanism of capping depressurization device for natural gas hydrates, Chinese Journal of Applied Mechanics. 2020", "CN105781497A—Collection device for submarine natural gas hydrates", "CN11648749A—Movable riser-type exploitation system and method for submarine superficial natural gas hydrates", etc. All these methods collect natural gas hydrates or decomposed products thereof through a conical cap device arranged on the seabed. (2) Mechanical collection methods: "CN103628880B—Environmentally-friendly exploitation method for natural gas hydrates in superficial non-diagenetic stratum on deep seabed", "CN104265300B—Exploitation method and device for submarine superficial natural gas hydrates", "CN104948143B—Exploitation method and device for submarine superficial natural gas hydrates", etc. All these methods collect massive natural gas hydrates through a mining machine arranged on the seabed.

The techniques based on the superficial exploitation theory still remain at the theoretical exploration stage. Due to the fact that only a small proportion of natural gas hydrates occur directly on the surface of the seabed and are dispersed on the seabed, the production efficiency is lower than expected, and the application range of these methods is limited.

SUMMARY

To solve the problems of existing exploitation techniques based on drilling depressurization, the present invention provides a self-entry exploitation device and method for marine natural gas hydrates according to the characteristic that marine natural gas hydrates typically occur in clayey sand or silty sediments.

The solution adopted by the invention to solve the above technical problems is as follows: a self-entry exploitation device for marine natural gas hydrates includes a self-entry structural body, a sand control device and a gas-liquid lifting system;

The self-entry structural body is a gravity anchor, and the sand control device and the gas-liquid lifting system are mounted on the self-entry structural body;

At least one cavity is formed between the self-entry structural body and the sand control device and is communicated with at least one channel;

The gas-liquid lifting system includes at least one lifting power device and has one end connected to the cavity and the other end extending out through a pipeline.

Furthermore, the channel includes a water pipe and a gas pipe, wherein the water pipe has one end connected to the lifting power device and the other end extending out through a pipeline, and the gas pipe has one end connected to the cavity and the other end extending out through a pipeline.

Furthermore, the lifting power device is an electric pump mounted in the cavity, the electric pump is an electric submersible centrifugal pump, an electric submersible screw pump or a mud pump, a gas-liquid separator is mounted in the cavity, an input end of the electric pump is connected to a liquid outlet of the gas-liquid separator, and an output end of the electric pump is connected to the water pipe.

Furthermore, the self-entry structural body includes a connecting component, a main component and a head component which are sequentially connected from top to bottom, wherein the connecting component is connected to an anchor cable, the head component is of a conical shape or an arc cap shape, the main component is of an upright shape and at least includes a perforated pipe wall, a cavity is formed in an inner side of the perforated pipe wall, a hole communicated with the cavity is formed in the perforated pipe wall, the sand control device is arranged in the hole and/or covers the hole, and a plurality of flange plates are regularly arranged on the periphery of the upper end of the main component.

Furthermore, the sand control device is a sand-control screen, a sand-control sieve tube, a mechanical sieve tube, a gravel sand-control layer, or a flexible fabric sand-control material layer.

Furthermore, a jet injection system is arranged on the self-entry structural body and includes a jet pipe embedded in the self-entry structural body and a plurality of jet orifices formed in the outer surface of the self-entry structural body and communicated with the jet pipe, and an inlet of the jet pipe is connected to an external high-pressure source through a pipeline.

Furthermore, an expansion bag sealing system is arranged on the self-entry structural body and includes a water-filling expansion bag and a water injection pipe arranged in the cavity and provided with an electromagnetic valve, the water-filling expansion bag is circular and is fixedly mounted on an upper portion of the periphery of the self-entry structural body, and the water injection pipe has an end connected to the electric pump and an end connected to the water-filling expansion bag.

Furthermore, an electric heating device is mounted on the inner wall of the self-entry structural body.

Furthermore, a feeler lever is vertically mounted at an internal lower end of the self-entry structural body; or, a vertical hole is formed in an internal lower end of the cavity, and the feeler lever is arranged in the hole; an electric telescopic rod is mounted in the self-entry structural body, and the feeler lever is mounted at the tail end of the electric telescopic rod; and the feeler lever includes a permeable pipe wall formed with a hole, the sand control device is mounted in the permeable pipe wall, and a flow passage is arranged in the middle of the sand control device and is communicated with the cavity.

An exploitation method of the self-entry exploitation device for marine natural gas hydrates includes the following steps.

(1) Selecting an exploitation area, and configuring the exploitation device;

(2) Releasing the self-entry structural body a certain distance above a seabed, so that the self-entry structural body enters together with the gas-liquid lifting system and the sand control device, the natural gas hydrate reservoir and/or the natural gas hydrate and free gas mixture reservoir and/or the free natural gas reservoir;

(3) Lifting by the gas-liquid lifting system, the liquid in the cavity to reduce the pressure in the cavity, so that the formation pressure around is reduced to promote natural gas hydrates in the stratum around to be decomposed into water and natural gas, which enter the cavity through the sand control device under the effect of a pressure difference, and the liquid and natural gas are lifted synchronously.

Furthermore, in the exploitation process of the natural gas hydrates, when natural gas hydrates within a range are exploited or the gas production efficiency is reduced to a value, the self-entry structural body is lifted gradually in case of a thick hydrate reservoir so as to realize gradual exploitation of the natural gas hydrate reservoir from bottom to top; or, the self-entry structural body located in the stratum is pulled out to withdraw the exploitation device or transfer the exploitation device to a new exploitation area to perform Steps 2-3 again to carry out exploitation.

Furthermore, after Step (2), the expansion bag sealing system is started to inject water into the water-filling expansion bag, so that the water-filling expansion bag expands to be closely attached to the natural gas hydrate reservoir to seal a flow passage between the outer surface of the self-entry structural body and the stratum around, and then high-pressure water containing solid particles is injected into the stratum around through the jet injection system; under the effect of the high-pressure water, the natural gas hydrate reservoir fractures, and then the jet injection system is closed; and the solid particles are filled in fractures to prevent the fractures from being closed completely to form seepage channels, so that the exploitation efficiency is improved, and the exploitation range is expanded.

Beneficial Effects

Compared with the prior art, the present invention has the following beneficial effects: drilling is not needed, the self-entry structural body can enter a natural gas hydrate reservoir or a free gas layer below the natural gas hydrate reservoir, so that depressurizing exploitation can be realized, and an exploitation system can be withdrawn; a series of problems such as high well drilling and completion cost of traditional deep-sea drilling exploitation methods, collapses of a wellbore caused by stratum instability, and damage to a sand control structure under the effect of formation pressure can be solved; and the invention can greatly reduce the exploitation cost of natural gas hydrates and is of great significance for commercial exploitation of marine natural gas hydrates.

BRIEF DESCRIPTION OF THE DRAWINGS

The present invention will be further explained below in conjunction with accompanying drawings.

Figure 1:
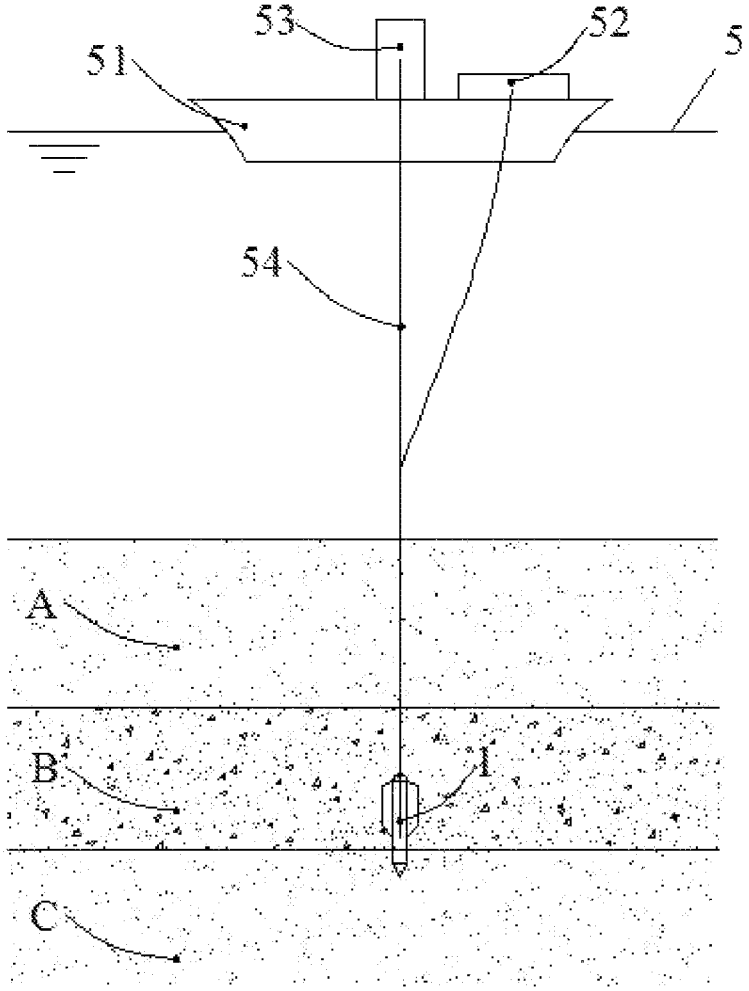
FIG. 1 is an overall diagram of the exploitation device.
Figure 2:
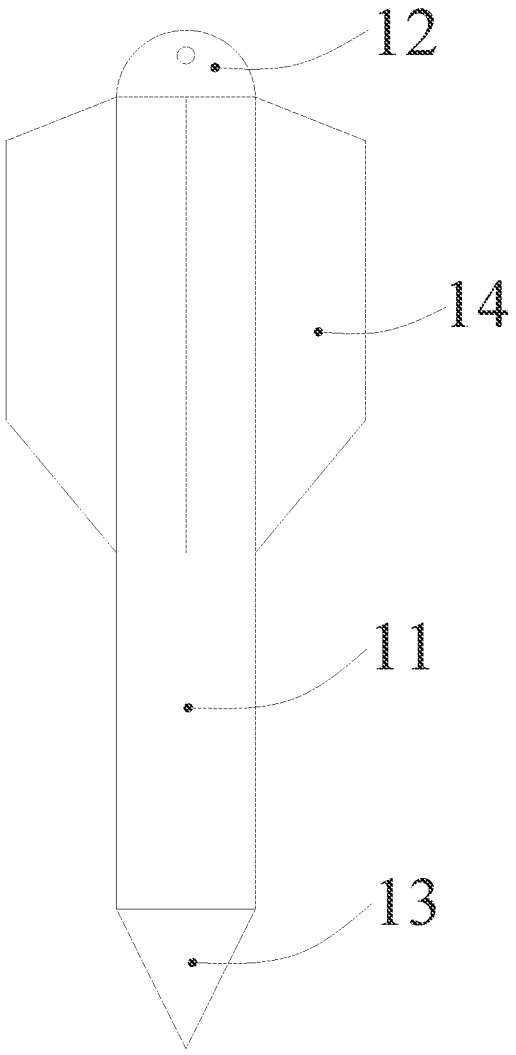
FIG. 2 is a structural diagram of the self-entry structural body.

In the figures: A—overlaying stratum on natural gas hydrates; B—natural gas hydrate reservoir; C—free gas reservoir below natural gas hydrates; 1—self—entry structural body; 11—main component; 111—perforated pipe wall; 112—perforated inner pipe wall; 113—end component for fixing sand control device in perforated pipe wall; 114—central weight, 115—auxiliary fixing component for fixing sand control device in perforated pipe wall; 12—connecting component; 13—head component; 14—flange plate; 2—sand control device; 21—cavity; 31—lifting power device; 32—gas—liquid separator; 41—water pipe; 42—gas pipe; 5—sea surface; 51—offshore support system; 52—offshore processing system; 53—cable mooring system; 54—anchor cable; 61—jet pipe; 62—jet orifice; 71—water—filling expansion bag; 81—electromagnetic induction coil; 91—feeler lever; 911—permeable pipe wall of feeler lever; 912—sand control device of feeler lever; 913, flow passage; 92—electric telescopic rod.

DETAILED DESCRIPTION OF THE EMBODIMENTS

The invention will be further explained below in conjunction with the accompanying drawings and specific embodiments.

As shown in FIG. 1-FIG. 10, a self-entry exploitation device for marine natural gas hydrates includes a self-entry structural body 1, a sand control device 2 and a gas-liquid lifting system;

The self-entry structural body is a gravity anchor, and the sand control device and the gas-liquid lifting system are mounted on the self-entry structural body; the self-entry structural body sinks in sea water at a high speed mainly by gravity and enters, together with the gas-liquid lifting system and the sand control device, a natural gas hydrate reservoir and/or a natural gas hydrate and free gas mixture layer and/or a free natural gas layer;

At least one cavity 21 is formed between the self-entry structural body and the sand control device and is communicated with at least one channel; the sand control device allows liquid and gas to pass through to enter the cavity and is able to filter out silt;

The gas-liquid lifting system includes at least one lifting power device 31, which has one end connected to the cavity and the other end extending out through a pipeline, and is used to lift liquid and/or gas in the cavity. When the liquid and/or gas is lifted, the pressure in the cavity can be reduced, so that the formation pressure around is reduced to promote natural gas hydrates to be decomposed into natural gas and water, which enter the cavity through the sand control device under the effect of a pressure difference, and exploitation of the natural gas hydrates is realized.

In this embodiment, the channel includes a water pipe 41 and a gas pipe 42, wherein one end of the water pipe is connected to the lifting power device, and the other end of the water pipe extends out through a pipeline; one end of the gas pipe is connected to the cavity, and the other end of the gas pipe extends out through a pipeline to collect gas; under the effect of the formation pressure and gravity, formation fluid enters the cavity, liquid in the cavity flows downwards and is pressed by the lifting power device into the water pipe to be lifted; the gas in the cavity enters the gas pipe to flow upwards; and when the liquid and gas are lifted, the pressure in the cavity can be reduced, so that the formation pressure around is reduced to promote the natural gas hydrates to be decomposed into natural gas and water, which enter the cavity through the sand control device under the effect of the pressure difference, and the exploitation of the natural gas hydrates is realized.

In this embodiment, the lifting power device is an electric pump mounted in the cavity, the electric pump is an electric submersible centrifugal pump, an electric submersible screw pump or a mud pump; a gas-liquid separator is mounted in the cavity, an input end of the electric pump is connected to a liquid outlet of the gas-liquid separator, and an output end of the electric pump is connected to the water pipe. The gas-liquid separator 32 is used to carry out secondary liquid-gas separation after liquid and gas are separated in the cavity by gravity, so that gas is prevented from entering the lifting power device. or, only one outlet is configured, liquid and gas are lifted and output by the same pipe and are then separated by the gas-liquid separator.

In this embodiment, the self-entry structural body includes a connecting component, a main component 11 and a head component 13 which are sequentially connected from top to bottom, wherein the connecting component 12 is connected to an anchor cable 54, the head component is of a conical shape or an arc cap shape and is used to reduce the sinking resistance of the self-entry structural body, the main component is of an upright shape and at least includes a perforated pipe wall 111, the cavity is formed in the inner side of the perforated pipe wall, a hole communicated with the cavity is formed in the perforated pipe wall, the sand control device is arranged in the hole and/or covers the hole, a plurality of flange plates 14 are regularly arranged on the periphery of the upper end of the main component and are used to adjust the descending pose of the self-entry structural body to reduce deflection, and the perforated pipe wall has a permeable and protective function, allow liquid and gas to pass through and protects the sand control device against erosion damage from formation pressure and fluid; and gas and liquid enter the cavity through the perforated pipe wall and the sand control device.

Figure 3:
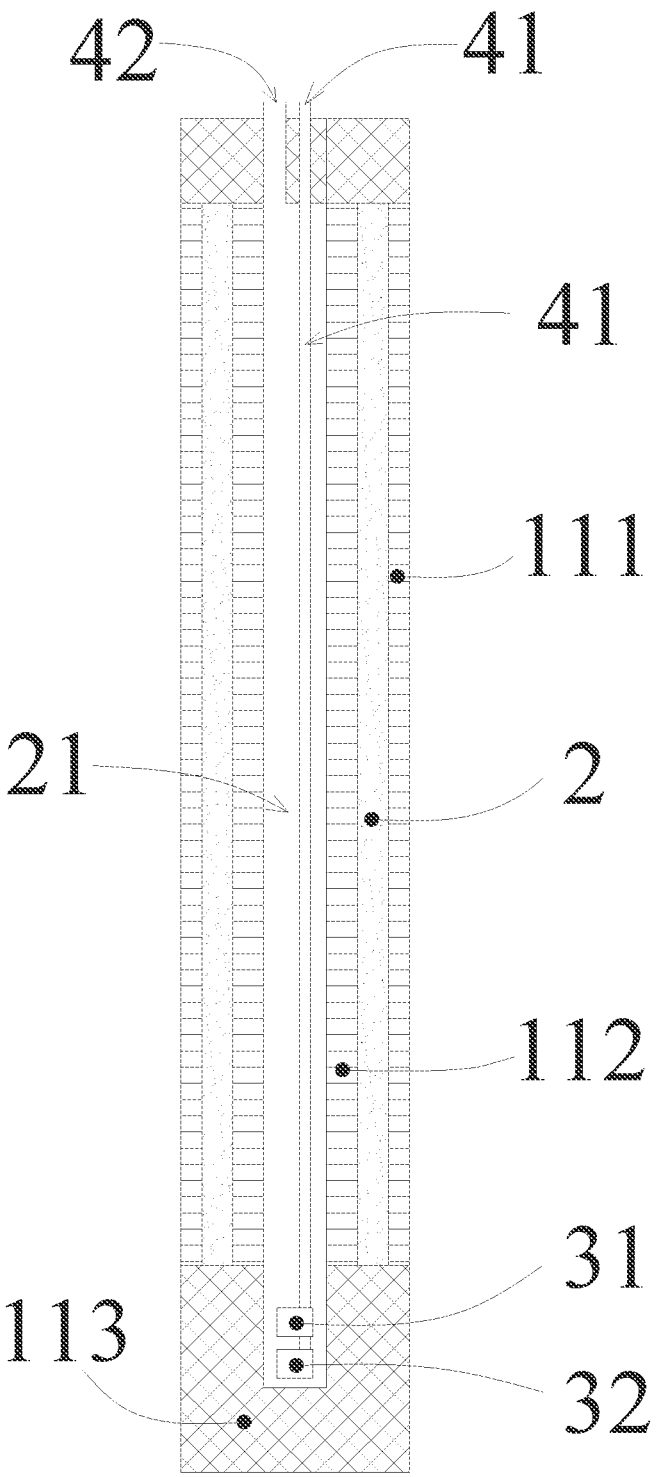
FIG. 3 is a structural diagram of the first implementation of a main component.
Figure 4:
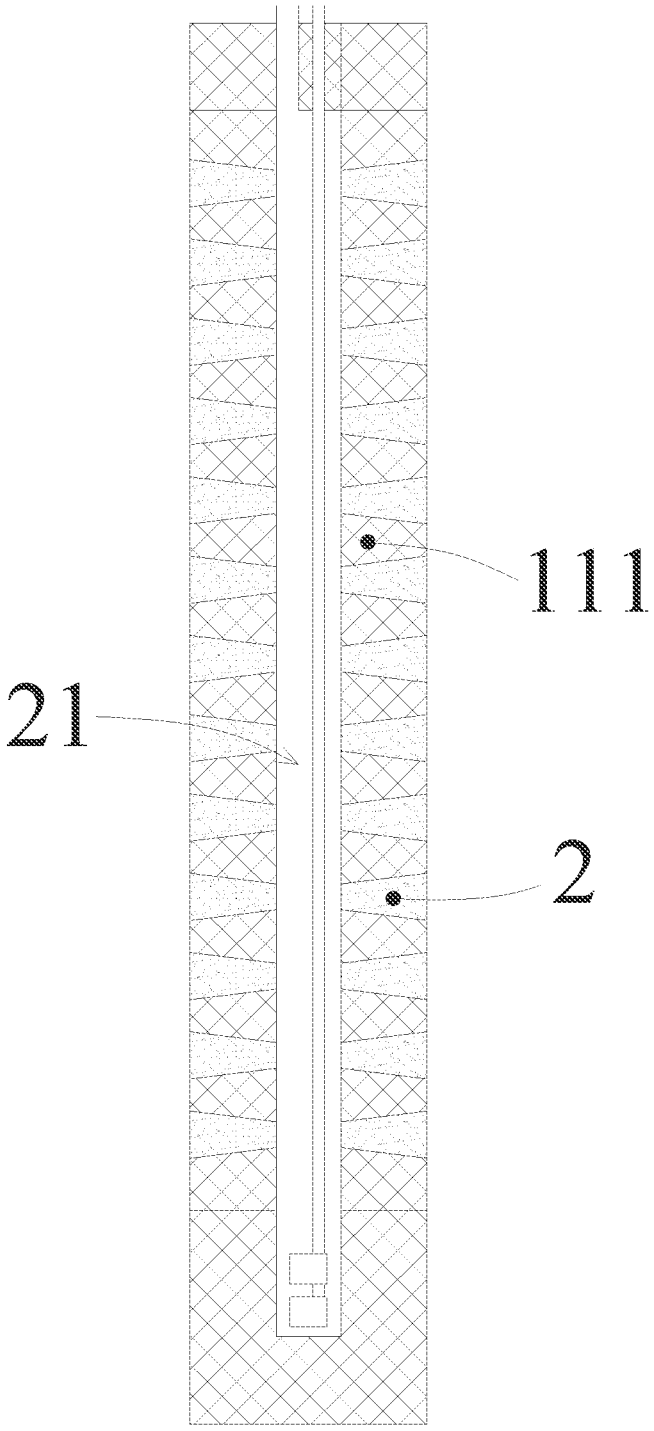
FIG. 4 is a structural diagram of the second implementation of the main component.
Figure 5:
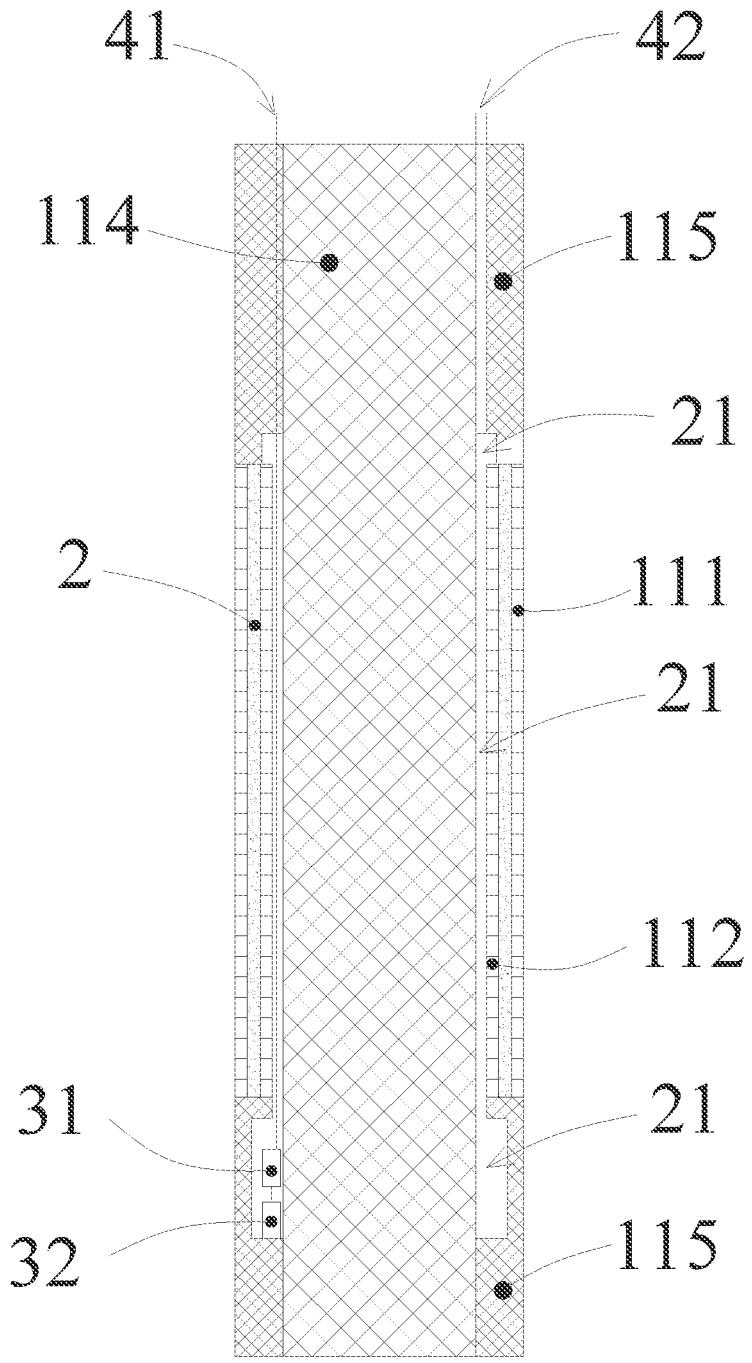
FIG. 5 is a structural diagram of the third implementation of the main component.
Figure 6:
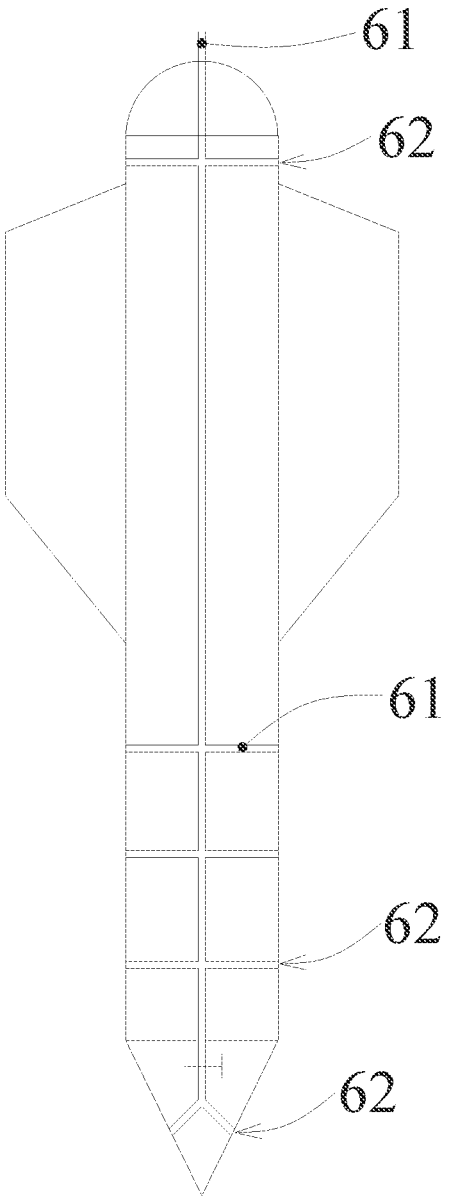
FIG. 6 is a structural diagram of the jet injection system.
Figure 7:
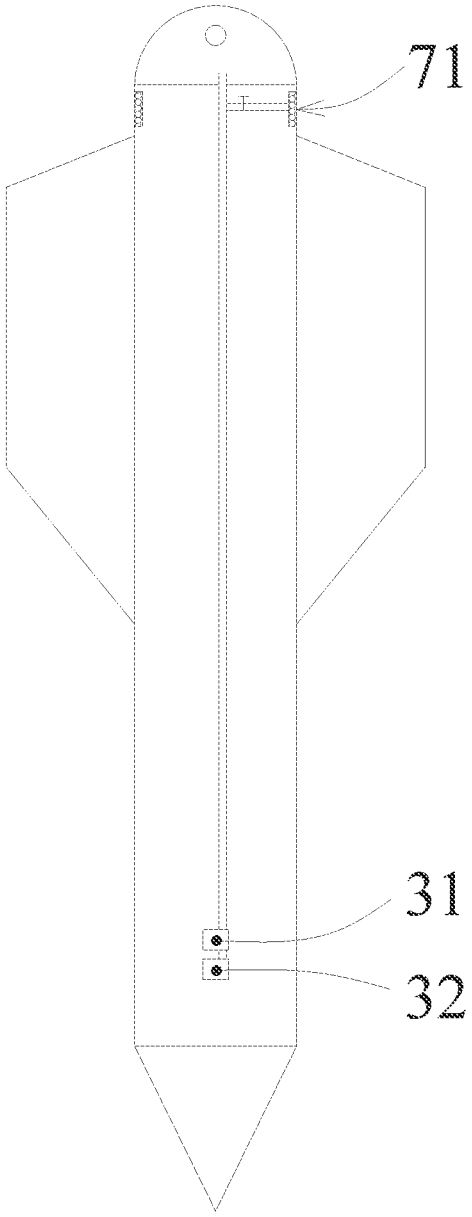
FIG. 7 is a structural diagram of the expansion bag sealing system.
Figure 8:
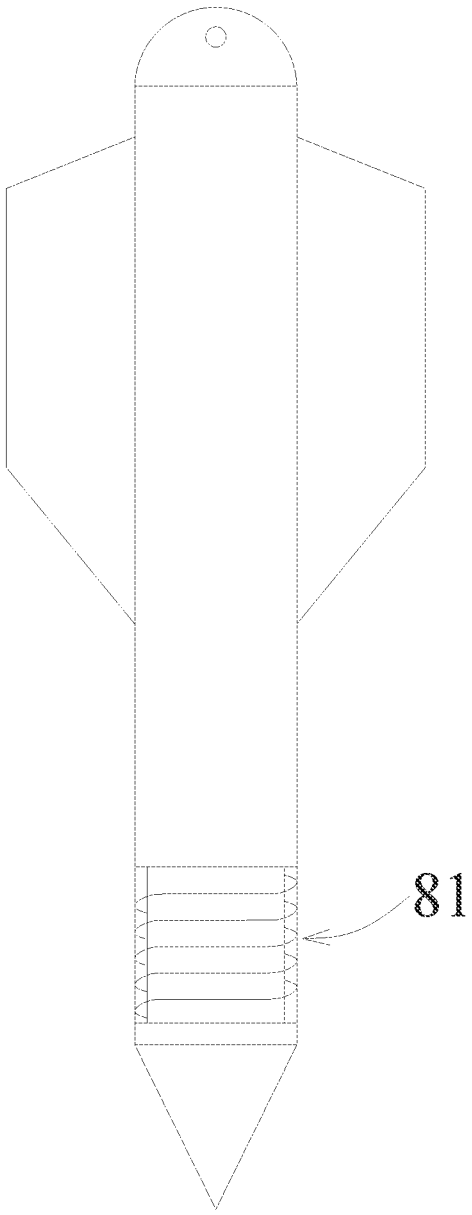
FIG. 8 is an installation structural diagram of the electric heating device.
Figure 9:
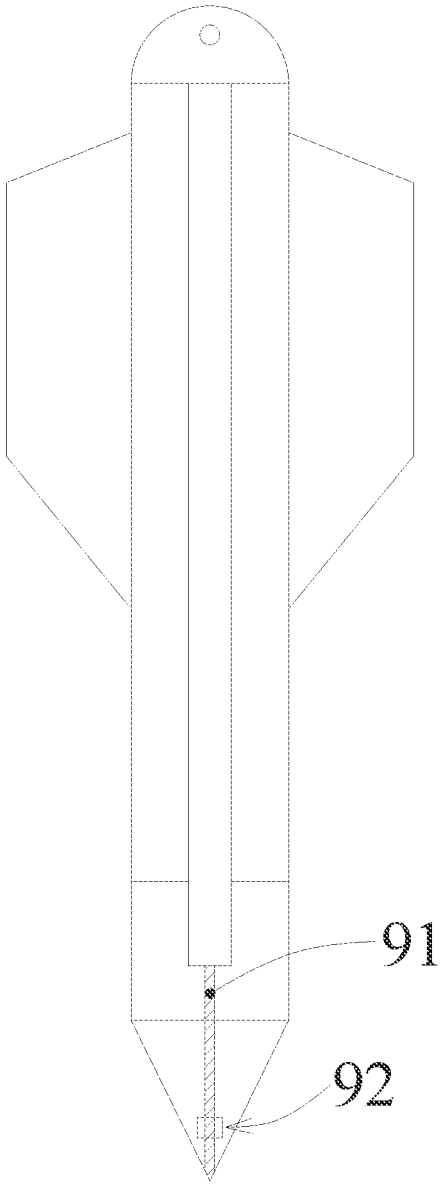
FIG. 9 is an installation structural diagram of the feeler lever.
Figure 10:
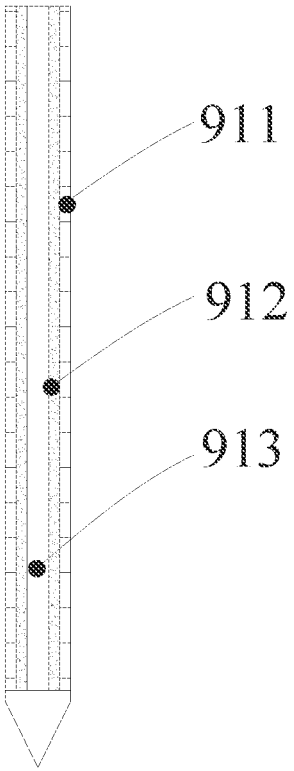
FIG. 10 is a structural diagram of the feeler lever.

As shown in FIG. 3, in the first implementation of the main component, the sand control device covers an inner side of the perforated pipe wall, and a hole is formed in the perforated pipe wall. As shown in FIG. 4, in the second implementation of the main component, a hole is formed in the perforated pipe wall, and the sand control device is arranged in the hole. As shown in FIG. 5, in the third implementation of the main component, the sand control device covers an inner side of the perforated pipe wall, a hole is formed in the perforated pipe wall, and a central weight 114 is arranged in the cavity to improve the overall structural strength of the main component. These three implementations are preferred embodiments of the invention, and other embodiments obtained without changing the essence of the invention should also fall within the protection scope of the invention.

In this embodiment, the sand control device is a sand-control screen, a sand-control sieve tube, a mechanical sieve tube, a gravel sand-control layer, a flexible fabric sand-control material layer, or a composite sand-control component formed by at least two of said components.

In this embodiment, a jet injection system is arranged on the self-entry structural body and includes a jet pipe 61 embedded in the self-entry structural body and a plurality of jet orifices 62 formed in the outer surface of the self-entry structural body and communicated with the jet pipe, an outlet of the jet pipe is connected to an external high-pressure source through a pipeline, the high-pressure source is an injection pump mounted on an offshore platform or a ship, the injection pump jets water, hot seawater, carbon dioxide or a chemical inhibitor to the stratum via the jet orifices through the jet pipe.

The jet injection system is used (1) to jet water to the reservoir around the self-entry structural body, when the natural gas hydrate decomposition range is insufficient, to enlarge a decomposition surface by water jet cutting so as to improve the exploitation efficiency; (2) to jet water to the position below the self-entry structural body, when the self-entry structural body cannot reach a desired depth in case where the hardness of the natural gas hydrates is high, so as to prompt the self-entry structural body to further descend by jet water cutting; (3) to inject hot seawater, carbon dioxide or a chemical inhibitor into an exploitation range to improve the natural gas hydrates decomposition efficiency; (4) to jet water to reduce silt around the exploitation device to improve the permeability; (5) to inject carbon dioxide above the reservoir to form carbon dioxide hydrates by the carbon dioxide and water around to improve the formation strength above the reservoir so as to improve the stability of the reservoir.

In this embodiment, an expansion bag sealing system is arranged on the self-entry structural body and includes a water-filling expansion bag 71 and a water injection pipe arranged in the cavity and provided with an electromagnetic valve, the water-filling expansion bag is circular and is fixedly mounted on an upper portion of the periphery of the self-entry structural body, one end of the water injection pipe is connected to the electric pump, and the other end of the water injection pipe is connected to the water-filling expansion bag. The water-filling expansion bag is closely attached to the natural gas hydrate reservoir after being filled with water, and the water injection pipe is supplied with injection power by the electric pump to inject part of formation fluid into the expansion bag. The expansion bag sealing system can reduce the influence of water and gas flowing in a water passage formed between the outer surface of the self-entry structural body and a stratum around on the depressurizing exploitation effect in the cavity, and the water-filling expansion bag system can prevent the disturbance on fluid in the passage and can cooperate with the jet injection system to carry out hydraulic fracturing to expand the exploitation range.

In this embodiment, the electric heating device 81 is mounted on the inner wall of the self-entry structural body and is used to heat the self-entry structural body which made of metal to realize large-scale heating of the natural gas hydrate reservoir, so that the decomposition speed of the natural gas hydrates is increased, and secondary generation of hydrates is prevented. The electric heating system may include an electromagnetic induction coil and an electromagnetic heating controller, wherein the electromagnetic induction coil surrounds the self-entry structural body which is typically made of steel, and the electromagnetic heating controller controls the electromagnetic induction coil to heat the self-entry structural body. By adoption of this solution, high heat conversion and transfer efficiency can be realized. Due to the lack of a large steel structure in a traditional wellbore, it is hard to realize large-scale heating of the natural gas hydrate reservoir based on the electromagnetic principle.

In this embodiment, a feeler lever 91 is vertically mounted at an internal lower end of the self-entry structural body; or, a vertical hole is formed in an internal lower end of the cavity, and the feeler lever is arranged in the hole; an electric telescopic rod 92 is mounted in the self-entry structural body, the feeler lever is mounted at the tail end of the electric telescopic rod; and the feeler lever includes a permeable pipe wall 911 formed with a hole, the sand control device 912 is mounted in the permeable pipe wall, and a flow passage 913 is arranged in the middle of the sand control device and is communicated with the cavity. The submerged depth of the feeler lever is greater than that of the self-entry structural body to guide deeper formation fluid to enter the cavity, so that the exploitation range is expanded, and the exploitation efficiency is improved.

In this embodiment, the exploitation device is assisted with an offshore support system 51, an offshore processing system 52, a cable mooring system 53, a power supply system and a control system during operation; the offshore support system is an offshore platform or a ship; the offshore processing system is arranged on the offshore support system, an output end of the electric pump is connected to the offshore processing system, and the offshore processing system is used to collect, process and store natural gas hydrate particles and is, for example, a storage cylinder; the offshore processing system includes a gas drying device, a gas compression device and a gas cylinder or a gas pipe; the cable mooring system is used to release the self-entry structural body to allow it to enter the natural gas hydrate reservoir and pull the self-entry structural body out when natural gas hydrates are exploited, and includes a cable and a cable control device, wherein the cable has one end connected to the connecting component of the self-entry structure and the other end connected to the cable control device; the cable control device is arranged on the offshore support system and can control the cable to be released or withdrawn; and the power supply system supplies power to all electric elements to provide power for exploitation, and the control system controls the operation of all devices. In addition, monitoring instruments such as a temperature sensor, a pressure sensor, a water flowmeter and a gas flowmeter may be arranged.

An exploitation method of the self-entry exploitation device for natural gas hydrates includes the following steps:

(1) An exploitation area is selected, and the exploitation device is configured;

(2) The self-entry structural body in a certain distance above the seabed is released to enter, together with the gas-liquid lifting system and the sand control device, the natural gas hydrate reservoir and/or the natural gas hydrate and free gas mixture reservoir and/or the free natural gas reservoir;

(3) The liquid in the cavity is lifted by the gas-liquid lifting system to reduce the pressure in the cavity, so that the formation pressure around is reduced to promote natural gas hydrates in the stratum around to be decomposed into water and natural gas, which enter the cavity through the sand control device under the effect of a pressure difference, and the liquid and natural gas are lifted synchronously.

In this embodiment, in the exploitation process of the natural gas hydrates, when natural gas hydrates within a certain range are exploited or the gas production efficiency is reduced to a certain value, the self-entry structural body is lifted gradually in case of a thick hydrate reservoir so as to realize gradual exploitation of the natural gas hydrate reservoir from bottom to top; or, the self-entry structural body located in the stratum is pulled out to withdraw the exploitation device or transfer the exploitation device to a new exploitation area to perform Steps 2-3 again to carry out exploitation.

In this embodiment, after Step (2), the expansion bag sealing system is started to inject water into the water-filling expansion bag, so that the water-filling expansion bag expands to be closely attached to the natural gas hydrate reservoir to seal the flow passage between the outer surface of the self-entry structural body and the stratum around, and then high-pressure water containing solid particles is injected into the stratum around through the jet injection system; under the effect of the high-pressure water, the natural gas hydrate reservoir fractures, and then the jet injection system is closed; and the solid particles are filled in fractures to prevent the fractures from being closed completely to form seepage channels, so that the exploitation efficiency is improved, and the exploitation range is expanded.

In this embodiment, in the case where an overlying stratum on the hydrate reservoir is soft, carbon dioxide is injected above/or around the self-entry structural body by the jet injection system between Step (2) and Step (3) to form carbon dioxide hydrates by the carbon dioxide and water around form, so that the stability of the stratum is improved.

In this embodiment, the gas-liquid lifting system can be controlled to open or close to control the water pressure in the cavity, and the pressure can be reduced to a desired value once or multiple times to adjust the production speed and stabilize the production capacity.

The gas-liquid lifting system can be intermittently started to exploit the hydrates intermittently. When the temperature of the reservoir is too low, exploitation is carried out after the temperature rises again, so that the exploitation efficiency can be improved.

In this embodiment, multiple exploitation devices can be used for exploitation at the same time to realize mass exploitation, and natural gas exploited by the exploitation devices is collected by a relay station and is then lifted to the processing system of the offshore platform or the ship. Adjacent exploitation devices may cooperate to carry out hydraulic fracturing to improve the production, and other adjacent exploitation devices may cooperate to carrying out heating to improve the production, that is, part of the exploitation devices are used to heat the natural gas hydrate reservoir, and the other part of adjacent exploitation devices are used for exploitation.

According to the design, the self-entry structural body can sink, together part of the structure of the gas-liquid lifting system and the sand control device, below a seabed surface to exploit a natural gas hydrate reservoir deep below the seabed surface, so that depressurizing exploitation can be realized, and the exploitation device can be withdrawn. Compared with the prior art, the invention has the following beneficial effects: (1) a deep-sea drilling ship is not needed in the construction process, so that the problem of high well drilling and completion cost of traditional sea-deep drilling exploitation methods is solved; (2) the main part of the self-entry structural body is made of a high-strength prefabricated structure, so that the problems that traditional concrete wellbores are prone to damage and collapses under the effect of formation pressure is solved; and the sand control device is protected by an alloy structure, so that the problem of silt generation and damage of the traditional wellbores is fundamentally solved; (3) the limitations that traditional capping depressurization methods can only exploit submarine superficial hydrates and are low in exploitation efficiency are overcome, the self-entry structural body can enter, together with an exploitation system, the natural gas hydrate reservoir deep below the seabed, and the effective exploitation area is large. To sum up, the invention can greatly reduce the exploitation cost of natural gas hydrates deep below the seabed surface and is of great significance for commercial exploitation of marine natural gas hydrates.

Unless otherwise specified, fixed connection of parts or components disclosed or involved in this patent should be appreciated as detachable fixed connection (such as with bolts or screws), non-detachable fixed connection (such as through riveting or welding). Of course, the fixed connection may also be replaced with an integrated structure (such as integrated fabrication through a casting process) (excluding a case where integrated formation is obviously unavailable).

It should be understood that in the description of this patent, the terms such as "lengthwise", "crosswise", "upper", "lower", "front", "back", "left", "right" "vertical", "horizontal", "top", "bottom", "inner" and "outer" are used to indicate directional or positional relation based on the drawings merely for the purpose of facilitating the description of this patent, do not indicate or imply that the device or element referred to must have a specific direction or must be configured and operated in a specific direction, and thus should not be construed as limitations of this patent.

The purposes, technical solutions and advantages of the invention are further expounded above with reference to the above preferred embodiments. It should be understood that the above embodiments are merely preferred ones of the invention, and are not intended to limit the invention. Any modifications, equivalent substations and improvements made without departing from the spirit and principle of the invention should also fall within the protection scope of the invention.

What is claimed is:

1. A self-entry exploitation device for marine natural gas hydrates, comprising a self-entry structural body, a sand control device and a gas-liquid lifting system;

the self-entry structural body is a gravity anchor, and the sand control device and the gas-liquid lifting system are mounted on the self-entry structural body; the self-entry structural body sinks in sea water at a speed mainly by gravity and enters, together with the gas-liquid lifting system and the sand control device through a sea bed surface into a natural gas hydrate reservoir and/or a natural gas hydrate and free gas mixture reservoir and/or a free natural gas reservoir;

at least one cavity is formed between the self-entry structural body and the sand control device and is communicated with at least one channel; the sand control device allows liquid and gas to pass through to enter the cavity and is able to filter out silt;

the gas-liquid lifting system comprises at least one lifting power device, has an end connected to the cavity and an end extending out through a pipeline, and is used to lift the liquid and/or gas in the cavity; when the liquid and/or gas is lifted, a pressure in the cavity is reduced to reduce a formation pressure around to promote natural gas hydrates to be decomposed into water and natural gas, which enter the cavity through the sand control device under the effect of a pressure difference, so that exploitation of the natural gas hydrates is realized;

wherein the at least one channel includes a water pipe and a gas pipe, the water pipe has an end connected to the at least one lifting power device and an end extending out through a pipeline, and the gas pipe has an end connected to the cavity and an end extending out through a pipeline to collect gas; under the effect of formation pressure and gravity, formation fluid enters the cavity, the liquid in the cavity flows downward and is pressed into the water pipe to be lifted by the at least one lifting power device, and the gas in the cavity flows upwards through the gas pipe;

the sand control device is a sand-colored screen, a sand-control sieve tube, a mechanical sieve tube, a gravel sand-control layer, or a flexible fabric sand-control material layer;

the at least one lifting power device is an electric pump mounted in the cavity, the electric pump is an electric submersible centrifugal pump, an electric submersible screw pump or a mud pump, a gas-liquid separator is mounted in the cavity, an input end of the electric pump is connected to a liquid outlet of the gas-liquid separator, and an output end of the electric pump is connected to the water pipe.

2. The self-entry exploitation device for marine natural gas hydrates as claimed in claim 1, wherein the self-entry structural body comprises a connecting component, a main component and a head component which are sequentially connected from top to bottom, the connecting component is connected to an anchor cable, the head component is of a conical shape or an arc cap shape, the main component is of an upright shape and at least comprises a perforated pipe wall, the cavity is formed in an inner side of the perforated pipe wall, a hole communicated with the cavity is formed in the perforated pipe wall, the sand control device is arranged in the hole and/or covers the hole, a plurality of flange plates are regularly arranged on a periphery of an upper end of the main component, and the perforated pipe wall has a permeable and protective function, allows liquid and gas to pass through and protects the sand control device against erosion damage from the formation pressure and liquid; and the gas and liquid enter the cavity through the perforated pipe wall and the sand control device.

3. The self-entry exploitation device for marine natural gas hydrates as claimed in claim 2, wherein a jet injection system is arranged on the self-entry structural body and comprises a jet pipe embedded in the self-entry structural body and a plurality of jet orifices formed in an outer surface of the self-entry structural body and communicated with the jet pipe, and an inlet of the jet pipe is connected to an external high-pressure source through a pipeline.

4. The self-entry exploitation device for marine natural gas hydrates as claimed in claim 1, wherein an expansion bag sealing system is arranged on the self-entry structural body and comprises a water-filling expansion bag and a water injection pipe arranged in the cavity and provided with an electromagnetic valve, the water-filling expansion bag is circular and is fixedly mounted on an upper portion of a periphery of the self-entry structural body, and the water injection pipe has an end connected to the electric pump and an end connected to the water-filling expansion bag; the water-filling expansion bag is closely attached to the natural gas hydrate reservoir after being filled with water to expand, and the water injection pipe is supplied with injection power by the electric pump to inject part of the formation fluid into the water-filling expansion body, and under some geological condition, the expansion bag sealing system can reduce an influence of water and gas flowing in a water passage between an outer surface of the self-entry structural body and a stratum around on a depressurizing exploitation effect in the cavity.

5. The self-entry exploitation device for marine natural gas hydrates as claimed in claim 2, wherein an electric heating device is mounted on an inner wall of the self-entry structural body, the electric heating device comprise an electromagnetic induction coil and an electromagnetic heating controller, the electromagnetic induction coil surrounds the self-entry structural body which is typically made of steel, and the electromagnetic heating controller controls the electromagnetic induction coil to heat the self-entry structure body.

6. The self-entry exploitation device for marine natural gas hydrates as claimed in claim 2, wherein a feeler lever is vertically mounted at an internal lower end of the self-entry structural body; or, a vertical hole is formed in an internal lower end of the cavity, and the feeler lever is arranged in the hole; an electric telescopic rod is mounted in the self-entry structural body, and the feeler lever is mounted at a tail end of the electric telescopic rod; the feeler lever comprises a permeable pipe wall formed with a hole, the sand control device is mounted in the permeable pipe wall, and a flow passage is arranged in a middle of the sand control device and is communicated with the cavity; and a submerged depth of the feeler lever is greater than that of the self-entry structural body to guide deeper formation fluid to enter the cavity, so that an exploitation range is expanded, and exploitation efficiency is improved.

7. An exploitation method of a self-entry exploitation device for marine natural gas hydrates, adopting the self-entry exploitation device for marine natural gas hydrates as claimed in claim 2, and comprising the following steps:

(1) Selecting an exploitation area, and configuring the exploitation device;

(2) Releasing the self-entry structural body a certain distance above a seabed, so that the self-entry structural body enters together with the gas-liquid lifting system and the sand control device, the natural gas hydrate reservoir and/or the natural gas hydrate and free gas mixture reservoir and/or the free natural gas reservoir;

(3) Lifting by the gas-liquid lifting system, the liquid in the cavity to reduce the pressure in the cavity, so that the formation pressure around is reduced to promote natural gas hydrates in a stratum around to be decomposed into water and natural gas, which enter the cavity through the sand control device under the effect of a pressure difference, and the liquid and natural gas are lifted synchronously.

8. The self-entry exploitation method for marine natural gas hydrates as claimed in claim 7, wherein in the exploitation process of the natural gas hydrates, when natural gas hydrates within a range are exploited or the gas production efficiency is reduced to a value, the self-entry structural body is lifted gradually in case of a thick hydrate reservoir so as to realize gradual exploitation of the natural gas hydrate reservoir from bottom to top; or, the self-entry structural body located in the stratum is pulled out to withdraw the exploitation device or transfer the exploitation device to a new exploitation area to perform Steps 2-3 again to carry out exploitation.

9. The self-entry exploitation method for marine natural gas hydrates as claimed in claim 7, wherein after Step (2), an expansion bag sealing system is started to inject water into a water-filling expansion bag, so that the water-filling expansion bag expands to be closely attached to the natural gas hydrate reservoir to seal a flow passage between an outer surface of the self-entry structural body and the stratum around, and then high-pressure water containing solid particles is injected into the stratum around through a jet injection system; under the effect of the high-pressure water, the natural gas hydrate reservoir fractures, and then the jet injection system is closed; and the solid particles are filled in fractures to prevent the fractures from being closed completely to form seepage channels, so that exploitation efficiency is improved, and an exploitation range is expanded.

* * * * *